United States Patent [19]

Frederick et al.

[11] 4,311,430

[45] Jan. 19, 1982

[54] METHOD OF FEEDING SHEETS

[75] Inventors: Louis J. Frederick, Fairmount; Kenneth E. Hoke, Marion; Jerrold W. Greene, Marion; Stephen D. Miller, Marion, all of Ind.

[73] Assignee: Greene Line Mfg. Corp., Marion, Ind.

[21] Appl. No.: 114,985

[22] Filed: Jan. 24, 1980

Related U.S. Application Data

[60] Division of Ser. No. 943,456, Sep. 18, 1978, Pat. No. 4,265,578, which is a continuation-in-part of Ser. No. 771,456, Feb. 24, 1977, Pat. No. 4,119,220.

[51] Int. Cl.[3] ..... B65G 57/08; B65G 59/08

[52] U.S. Cl. ..... 414/786; 198/423; 271/3.1; 271/151; 271/201; 414/33; 414/37; 414/130; 414/754

[58] Field of Search ..... 414/786, 754, 112, 130, 414/36, 114, 33, 37; 271/3.1, 199, 200, 201, 265, 270, 149, 150, 151, 35, 165; 198/423, 406, 410, 373

[56] References Cited

U.S. PATENT DOCUMENTS

| | | | |
|---|---|---|---|
| 2,707,568 | 5/1955 | Jackson | 414/112 X |
| 3,900,115 | 8/1975 | Kumagai | 414/130 X |
| 3,982,750 | 9/1976 | Pulda | 414/130 X |
| 4,081,181 | 3/1978 | Crowe et al. | 414/130 X |

*Primary Examiner*—Leslie J. Paperner

*Attorney, Agent, or Firm*—Woodard, Weikart, Emhardt & Naughton

[57] ABSTRACT

A sheet feeding apparatus and method in which the stack of sheets forming the load are fed onto a pivoting cradle whose pivot axis is at a height permitting substantially horizontal delivery of the sheets to the receiving conveyor. After each loading of the cradle, it is moved horizontally toward the receiving conveyor an amount sufficient to cover any feeding gap on the conveyor caused by the excursion of the cradle through its load position. A pivotable conveyor aft of the receiving conveyor includes a backstop gate assembly which is adjustable to control the thickness of flow of the shingled sheets.

2 Claims, 13 Drawing Figures

METHOD OF FEEDING SHEETS

This is a division of application Ser. No. 943,456 now U.S. Pat. No. 4,265,578, filed Sept. 18, 1978 which is a continuation-in-part of Ser. No. 771,456, filed Feb. 24, 1977, now U.S. Pat. No. 4,119,220.

BACKGROUND OF THE INVENTION

Sheet feeding apparatus of the general type herein disclosed has become widely used in the corrugated container industry and heavy manual labor has thus been eliminated at various points throughout the typical box plant. Such automatic feeding apparatus is utilized in the feeding of printer-slotters, die cutters, folder-gluers and the like. An apparatus of this type is disclosed in the Hoke et al., U.S. Pat. No. 3,815,762.

Where the press hopper or other apparatus is being fed by a feed transfer conveyor which presents the sheets sequentially, in "shingled" or overlapping form, to the apparatus, the reloading cycle of the sheet feeding apparatus presents difficulties. Since the feeder cradle must be loaded in stack-size increments, in the time interval between feeding of the last sheet from the cradle and the feeding of the initial sheets from the reloaded cradle (the time necessary for the cradle to move through its reloading cycle) a gap is created on the shingle or series flow of sheets on the feed transfer conveyor. The apparatus of the present invention overcomes this difficulty by moving the cradle horizontally, after each reloading of the craddle, toward the receiving conveyor an amount sufficient to cover the feeding gap caused by the excursion of the cradle through its load position. Elimination of this gap in the shingle or sequence feeding the press between cradle loadings makes unnecessary the intermittent stoppage of the press for feeder reloading, a characteristic of prior art feeding apparatus. The general subject of cradles is well known and is shown in, for example, U.S. Pat. Nos. 3,982,750, 2,707,568 and 2,863,571.

The capability for horizontal motion of the cradle is also utilized during momentary stoppages of the press or other apparatus being fed. If, during feeding or "shingling" of sheets from the cradle to the receiving conveyor the receiving conveyor should stop, because the press hopper is full, for example, the cradle will continue feeding sheets but will retreat horizontally away from the receiving conveyor. Since the dispensing tip of the cradle overlies the receiving conveyor, sheets will be deposited along the momentarily stationary, receiving conveyor. The feed sequence is thus unbroken upon momentary receiving conveyor stoppages. When the conveyor restarts, the cradle will halt its retreating, horizontal motion and continue feeding sheets to the now-moving receiving conveyor. If the receiving conveyor again halts, the cradle will continue its retreat until a predetermined home position is reached. When emptied, and in this home position, the cradle will immediately go through its reloading cycle and then advance forward on the receiving conveyor to its advanced position and begin feeding sheets from its newly loaded stack.

The apparatus of the present invention is further characterized by a generally L-shaped cradle which receives a stack load between shaped members forming its upright leg. Load support members are then moved to a position between the spaced leg members and support the tipped stack when the cradle is pivoted into feeding position. The pivotal axis of the cradle is at a level such that when the cradle has been moved to feed position and the included angle between the cradle legs has been increased from 90° to approximately 180°, the sheets will be fed from the cradle substantially horizontally onto the receiving conveyor. The up-hill feed characteristic of conventional feed apparatus is thus eliminated.

The invention disclosed herein also includes an adjustable backstop assembly to control the thickness of flow of the shingled sheets moving on the conveyor. In U.S. Pat. No. 3,815,762, there is disclosed a vertical wall for allowing sheets to accumulate on a conveyor prior to passing between the wall and conveyor. Likewise in U.S. Pat. No. 3,905,487, a gate is provided to momentarily stop the flow of sheets on a conveyor.

SUMMARY OF THE INVENTION

One embodiment of the present invention is an apparatus for feeding sheets in a shingled condition comprising support means for supporting sheets in a stack in an upright position, a cradle for the stack formed by spaced, generally L-shaped members, means for pivotally supporting the cradle on a horizontal pivotal axis, one set of legs of the L-shaped members carrying conveying means therebetween, additional means for pivoting the cradle about the axis between a load position in which the conveying means and the one set of legs are horizontal and receive the stack moving horizontally from the supporting means, the stack entering between the other set of legs positioned vertically, and a feed position in which the other set of legs is horizontal, and load support means moved laterally into the space between the other set of legs of the cradle prior to pivotal movement of the cradle toward the feed position, a first conveyor means aligned with the cradle and having means operable to convey the sheets away from the cradle in the feed position, a gate positioned over the first conveyor means having a bottom end and defining an upwardly extending plane against which sheets upon the first conveyor means may form a second stack of sheets, and means connected to the gate operable to move the bottom end to and from the first conveyor means defining a variable passage through which sheets move from the bottom of the second stack in shingled fashion.

Another embodiment of the present invention is a method of feeding sheets comprising the steps of aligning a plurality of sheets in a first vertical stack having a vertical stack axis, supporting the stack with a bottom horizontal surface and a vertical surface forming an included angle of 90°, tilting the stack with the vertical surface moving toward horizontal, increasing the included angle during the tilting step allowing the sheets to assume a shingled configuration, feeding the sheets in a horizontal direction in a shingled configuration on a conveyor, temporarily accumulating in a second vertical stack the loading sheets being fed during the feeding step, feeding sheets from the bottom of the second vertical stack in shingled fashion while restraining sheets thereabove in the second stack.

It is an object of the present invention to provide a new and improved apparatus for continuously feeding corrugated sheets.

A further object of the present invention is to provide an apparatus which receives a stack of corrugated sheets and in turn feeds the corrugated sheets in shingled fashion.

Yet another object of the present invention is to provide a new and improved method for continuously feeding corrugated board sheets in shingled fashion.

Related objects and advantages of the present invention will be apparent from the following description.

DESCRIPTION OF THE PREFERRED EMBODIMENTS

Figure 1:
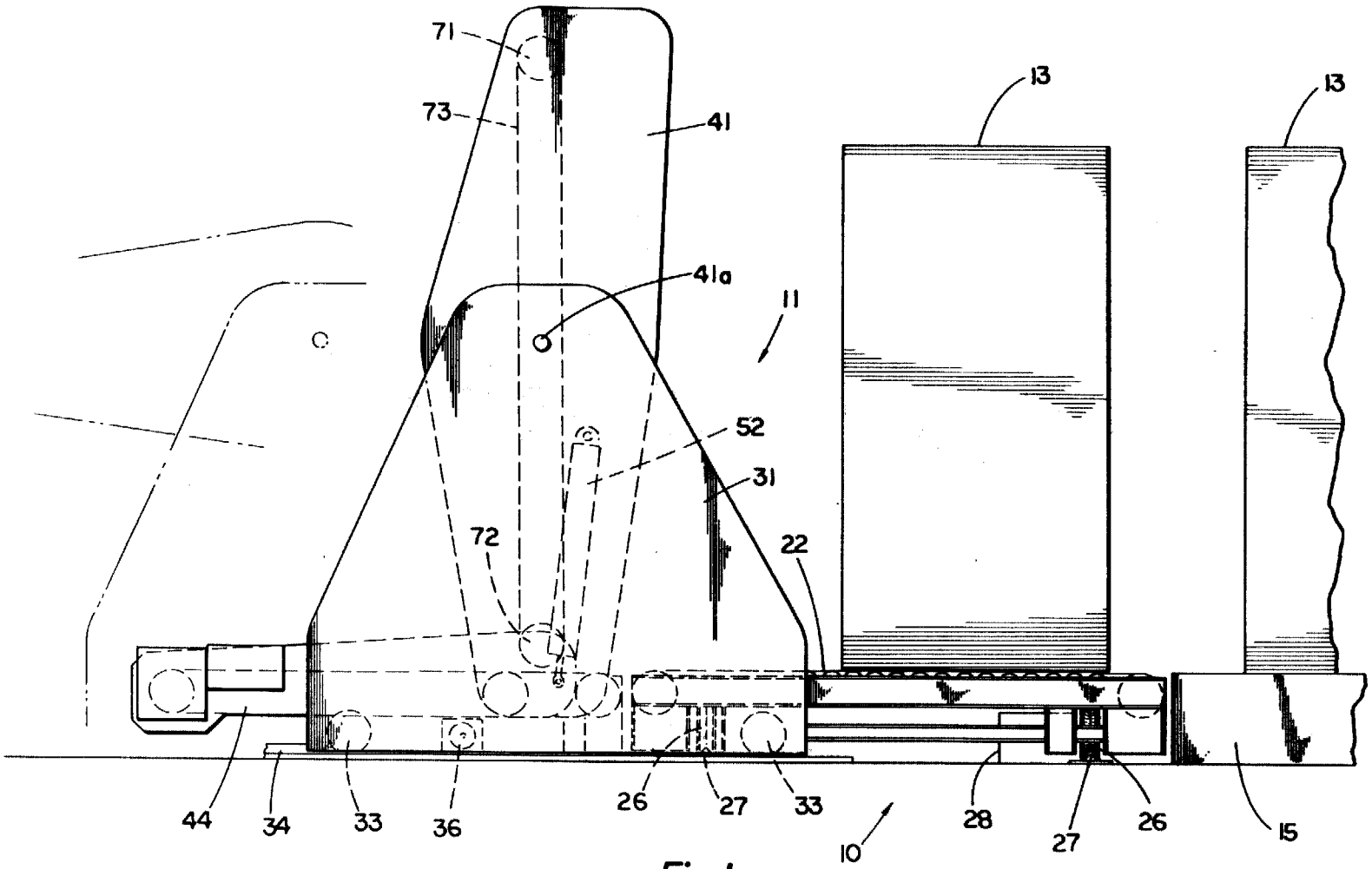
FIG. 1 is a side view of the cradle component of the apparatus in load position with subsequent positions of the cradle being shown in broken lines.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
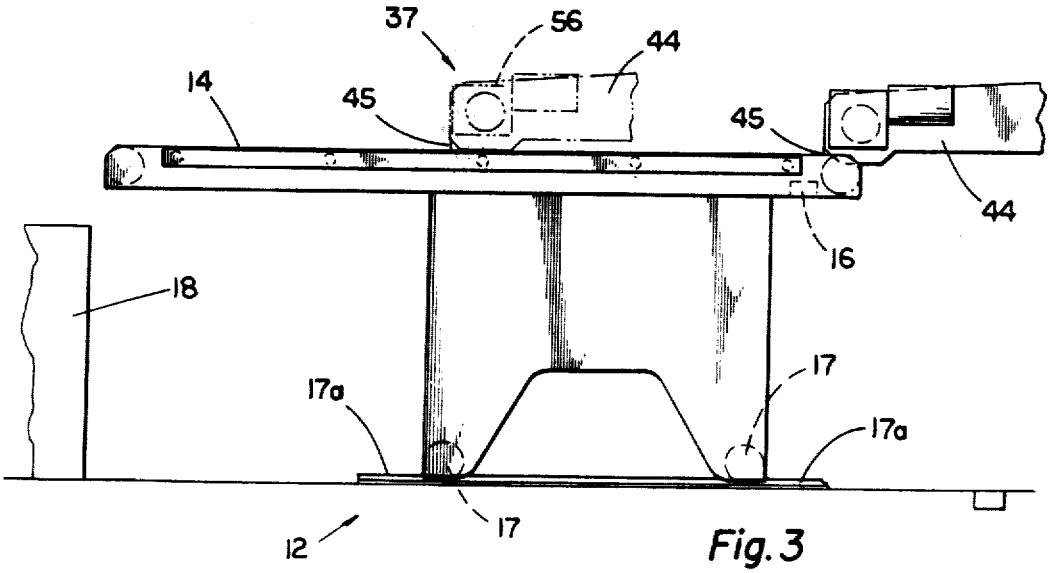
FIG. 3 is a side view of the receiving conveyor component of the apparatus and showing a portion of the cradle in feed position.

Referring initially to FIGS. 1 and 3, it will be evident that the apparatus has three components. A support means or load-centering section 10, a cradle indicated generally at 11 and a receiving or transfer conveyor 12. The centering section 10 receives a stack 13 of corrugated board sheets to be printed or otherwise processed from a storage conveyor, indicated at 15, having a conventional automatic feed and not a part of the present invention.

The receiving conveyor 12 is formed by a belt-over-roller powered conveyor 14, driven by a variable speed drive motor 16 (FIG. 3), the conveyor being supported by a frame carrying wheels 17 which may travel along a track 17*a*. The delivery end of the conveyor 14 is adjacent a press hopper fragmentarily shown at 18 in FIG. 3 which receives the sheets flowing from the conveyor when it is in operation. Conventionally, a control is exerted on the conveyor drive motor 16 such that it halts the conveyor when the hopper 18 is full. The receiving conveyor is movable toward and away from the hopper and press to permit access to the press for set-up and to accommodate running sheet lots of differing dimensions. Also aiding in the accommodation of variously sized stacks are the movable sheet-carrying runners 21 which can be moved outwardly or inwardly, as desired, on telescoping support rods. It is understood that runners 21 are not necessary to the practice of the instant invention. The variable speed drive for the conveyor 14 permits the thickness of the "shingle" or bevelled, overlapping pile of sheets on the conveyor to be adjusted.

The centering conveyor 10 includes a powered, belt-over-roller conveyor 22, driven by a motor 23 (FIG. 2), or similar drive means. The conveyor 22 is carried on a frame provided with grooved wheels 26 (FIG. 1) which travel on transverse, parallel tracks 27. A drive motor such as motor 28 (FIG. 1) may be utilized to adjust the position of the stack 13 by moving the conveyor transversely on tracks 27 as required to center the conveyor 22, and hence the stack for loading into cradle 11.

Figure 7:
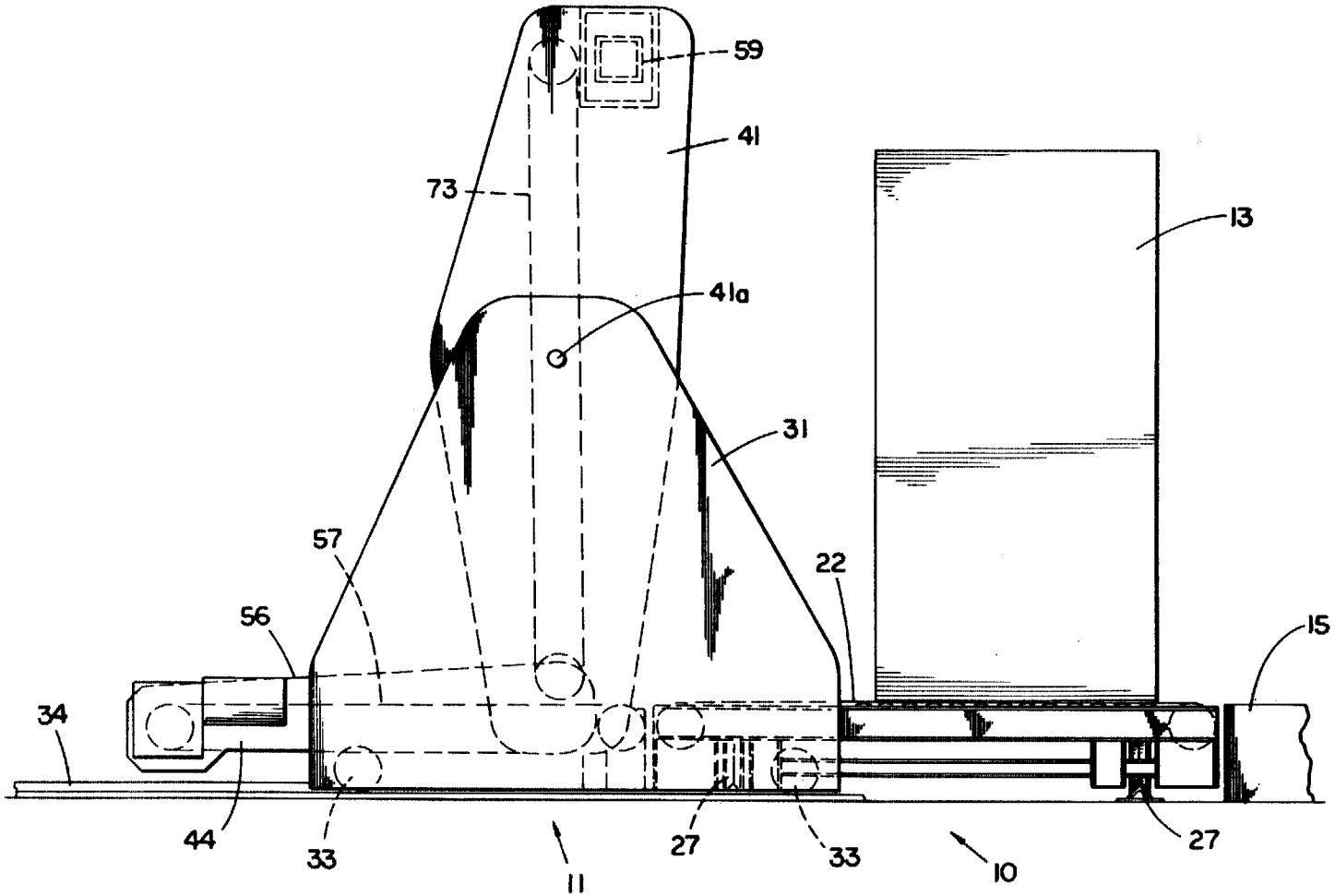
FIG. 7 is a side view of the cradle component in load position, with obscuring portions of the drive mechanism omitted.

The cradle, or pivoting feed conveyor, 11 includes supporting elements including stanchions 31 and 32 (FIG. 2), upon which the L-shaped cradle structure proper, to be subsequently described, is pivotally supported. The stanchions are supported on wheels 33 (FIG. 1) which ride on tracks 34 shown fragmentarily in FIG. 1 and more extensively in FIG. 7. Horizontal motion of the stanchions, and the structure they support is accomplished by a chain drive from the motor 36 (FIG. 1) to a sprocket rotationally locked to the front or leftward (as viewed in FIG. 1) wheels 33 on the two stanchions. The cradle stanchions and the cradle structure during the operational sequence are moved, horizontally, on tracks 34 from a load position, shown in sold lines in FIGS. 1 and 7, to an intermediate position, shown fragmentarily in broken lines in FIG. 1 and in solid lines in FIG. 8 and, finally, to a feed position, shown fragmentarily in broken lines identified at 37 in FIG. 3, this position being leftwardly beyond the intermediate position of FIGS. 1 and 10 and, in this position, the delivery tip of the conveyor overlaps the receiving conveyor 14.

As previously mentioned, the cradle structure proper is generally L-shaped and is formed by a duplicate set of horizontal legs 44 and 46, transverse plate 47 spanning the legs 44 and 46. It will be understood that while only legs 41 and 44 are visible in the various side views in the drawings, the opposite counterparts 42 and 46 of these legs move in unison with them.

Figure 5:
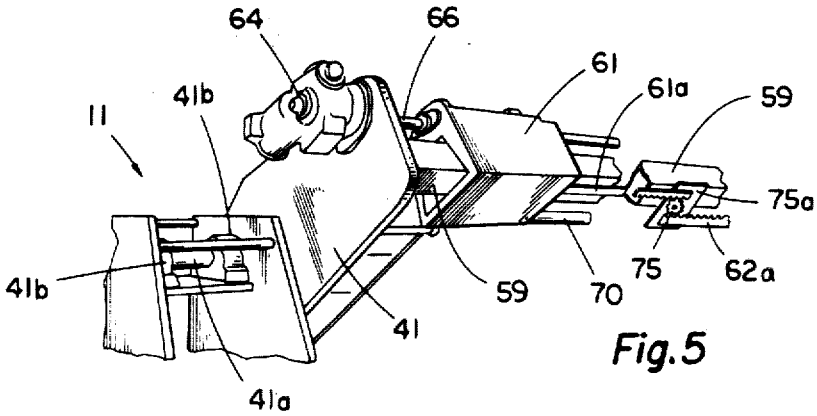
FIG. 5 is a fragmentary, perspective view of the cradle component and one of its supporting stanchions.

Intermediate the ends of legs 41 and 42, stub-shafts 41*a* and 42*a* extend outwardly from the respective legs and are journalled in bearings 41*b* (FIG. 5). As will be evident, particularly in FIG. 5, the stanchions are formed by spaced steel plates, properly braced transversely, and enclosing a motor 51 (FIG. 2) connected by a suitable transmission to the shaft 41*a* for pivotally moving the L-shaped cradle about the pivotal axis defined by shafts 41*a* and 42*a*. It will be understood that a hydraulic cylinder, properly mounted, might also be used, in place of motor 51, to pivotally move the cradle. As indicated in FIG. 1, the set of legs 41 and 42 extend upwardly at approximately 90° to the horizontal set of legs 44 and 46 but, by means of the hydraulic cylinder 52 (FIG. 1), these legs may be angularly moved (about pivot 43) with relation to each other so as to vary the included angle between them.

Figure 2:
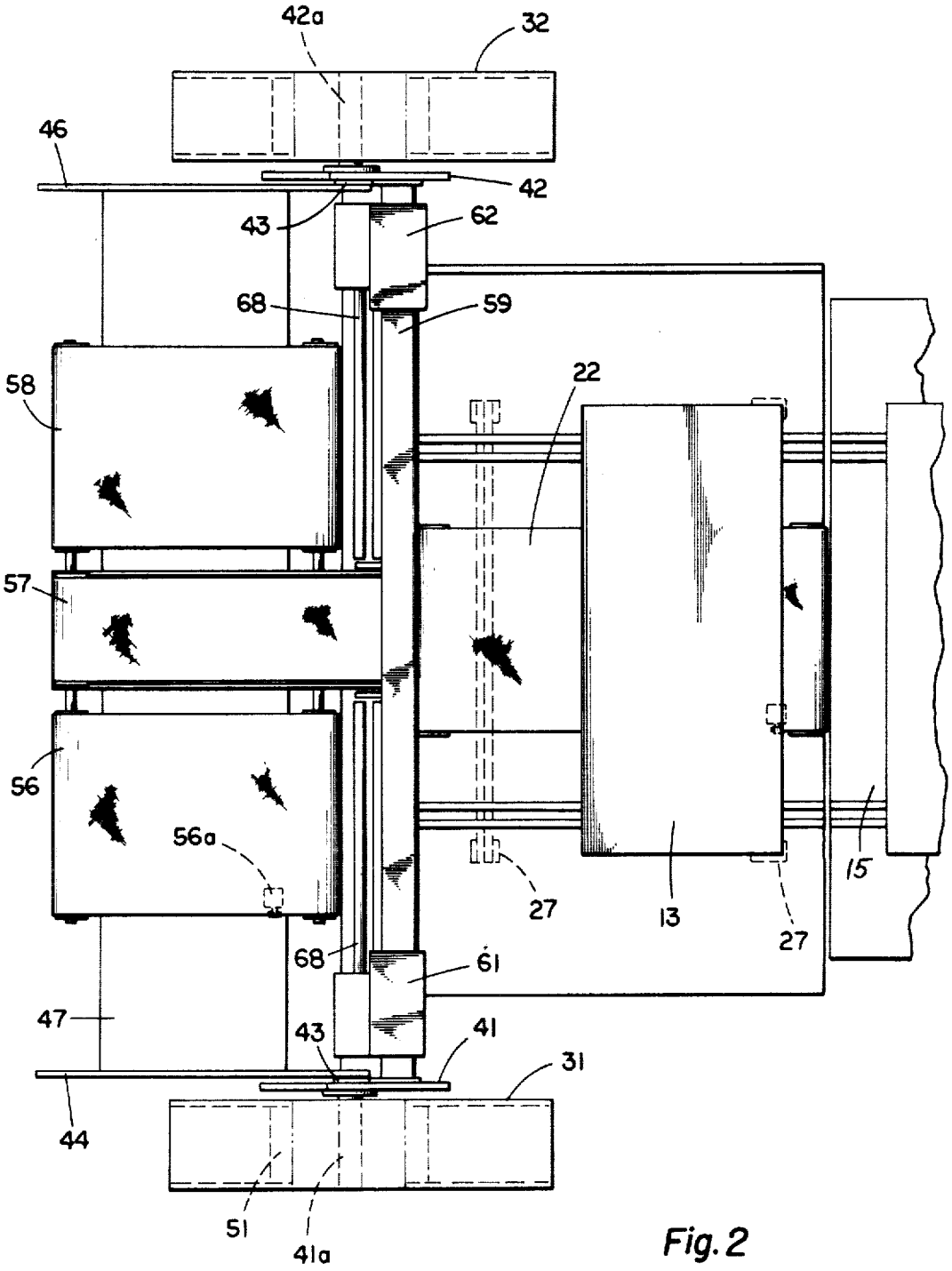
FIG. 2 is a top plan view of the structure shown in FIG. 1.
Figure 6:
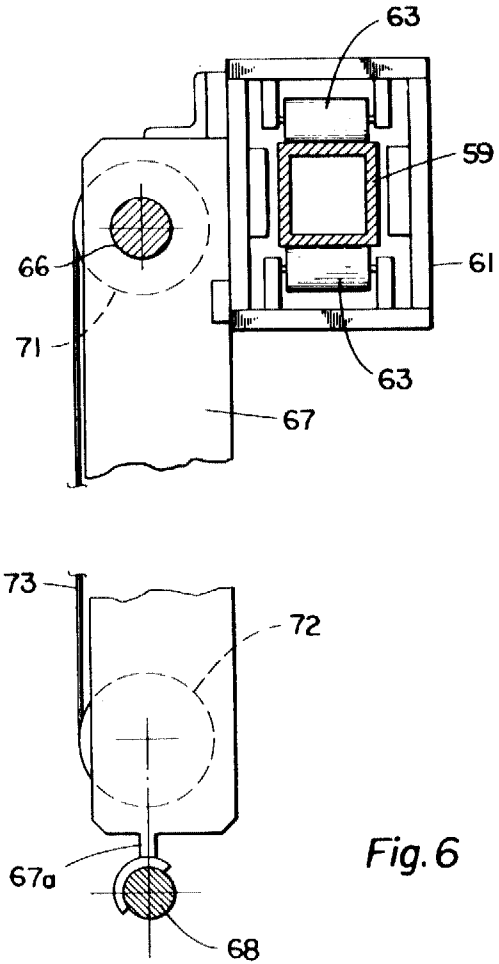
FIG. 6 is an enlarged, fragmentary, side sectional view of the transport mechanism for the load support structure on the cradle.

The horizontal legs 44 and 46 carry, between them, three belt-over-roller conveyors identified at 56, 57 and 58 in FIG. 2 and driven in unison, by drive motor 56*a*. A sensing element including flexible fingers 45 (FIG. 3) carried at the tip of members 44 and 46 functions to sense the trailing edge of the material already on the receiving conveyor 12. Extending between the vertical legs 41 and 42, and secured to them is a guide tube 59 (FIG. 6). Riding on the guide tube are two rectangular guide housings 61 and 62 (FIG. 2), one of which (61) is shown in FIG. 5 and in cross-sectional detail in FIG. 6. As may be seen in FIG. 6, the housings carry internal rollers 63 which engage the tube 59 permitting the housings to slide smoothly along the tube.

The drive means for moving the housings from their outboard positions of FIGS. 2 and 5 toward the center of the structure is shown in FIG. 5. A suitable motor and reduction gearing 64 rotate transverse shaft 66 which drives conveyor belts 73 to be subsequently referred to with reference to FIG. 6. A hydraulic cylinder 70 extends between, and has its opposite ends secured to, the guide tube 59 and guide housing 62 (FIG. 2). Movement of the thrust rod of the hydraulic cylinder moves the housings 61 and 62 toward each other, that is, toward the center of the structure so that they assume a position in which they are centered on the width of conveyors 56 and 58, as viewed in FIG. 2. A rack and pinion assembly stabilizes and insures synchronization of the relative motion of the housings 61 and 62. This assembly includes toothed rack members 61*a* and 62*a* which extend horizontally from the housings 61 and 62, respectively, and mesh with an idler gear 75 journalled on a stub-shaft carried by a plate 75*a* secured to the tube 59 at is midpoint.

As may best be seen in FIG. 6, the housings 61 and 62 each carry spaced, load-support bars or plates 67 which depend from the housings and are braced at their base by arcuate foot portions 67*a* which overlie and ride along the transverse guide rods 68 which extend inwardly, axially aligned, from the legs 44 and 46. The plates 67, a pair of which are carried by each of the housings 61 and 62, support transverse rollers 71 and 72 over which is driven a conveyor belt 73. Each of the movable housings 61 and 62 carries a conveyor belt 73, the drive for the rollers being provided by the motor 64 (FIG. 5) which rotates shaft 66, the drive shaft for the transverse rollers. As will be evident from FIG. 2, with the housings 61 and 62 in their outer or load clearance position, conveyor 22 may move the stack of sheets 13 under the tube 59, through the unobstructed space between the housings 61 and 62 and on the conveyors 56, 57 and 58. Subsequently, the housings 61 and 62, with their load support plates 67 and conveyors 73, may be moved inwardly to back the stack as it stands erect on the conveyors 56, 57 and 58.

FIGS. 7–10 illustrate the operational sequence of the apparatus. In operation, referring initially to FIG. 7, the storage conveyor line 15, not part of the present invention, automatically delivers a stack 13 of corrugated sheets to centering section 10 whenever it is vacant. In the centering section, the position of the stack may be shifted transversely on tracks 27 to center the stack between the upright members 41 and 42 of the L-shaped cradle 11. The conveyor 22 of the centering component 10 may then be operated to insert the stack onto the conveyors 56, 57 and 58 (conveyors 56, 57 and 58 operating in conjunction with conveyor 22 to complete this movement of the stack), the stack moving between members 41 and 42 beneath guide tube 59. Once the stack has cleared the centering section 10, this component may be returned to a physically centered position with respect to the cradle for receiving the next stack.

Figure 8:
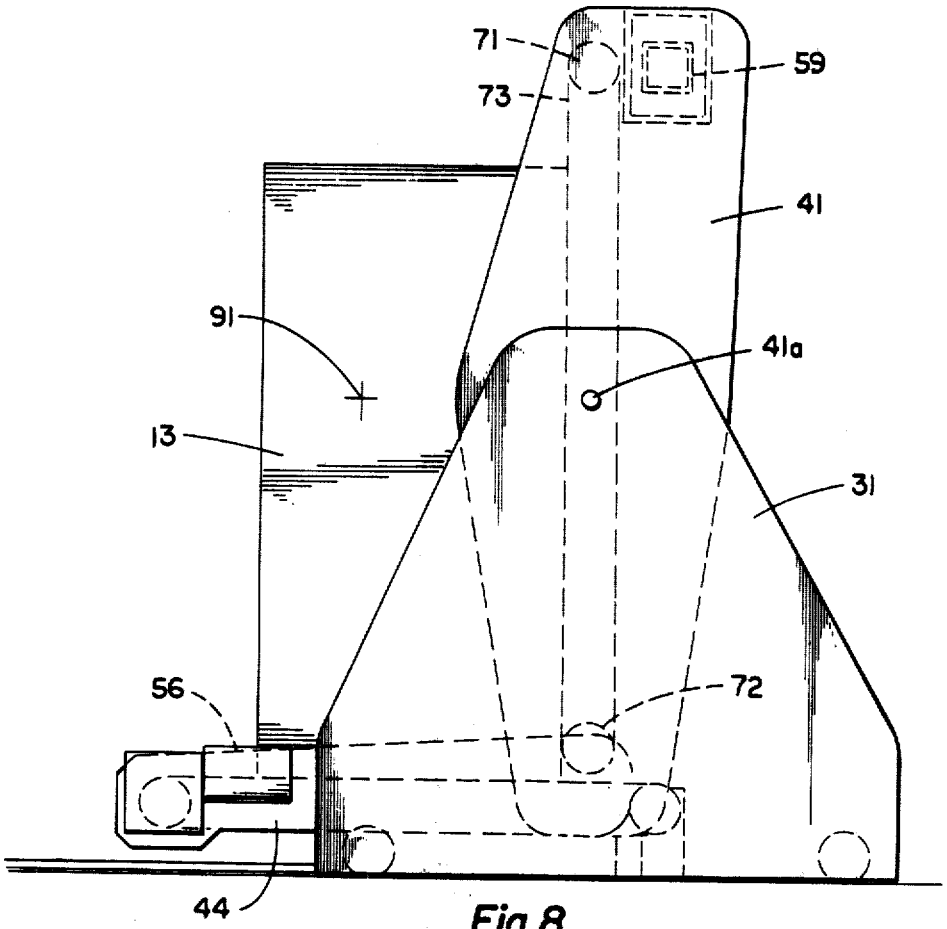
FIG. 8 is a view similar to FIG. 7 but showing a corrugated sheet stack located on the cradle.

After the stack has reached the position shown in FIG. 8, the cradle 11 will advance leftwardly along tracks 34 until the pivot axis 41*a* reaches the position indicated at 91 in FIG. 8. This intermediate position of the cradle stanchions 31 and 32 is illustrated in solid lines in FIG. 9 with the initial position of the stanchions and cradle (the position of FIG. 8) being indicated by broken lines at 92.

During this leftward travel of the cradle, the housings 61 and 62 will be moved by their drive means 70 (FIG. 5) toward the transverse center of the cradle bringing load-support plates 67, and the conveyors 73 carried between them, into a position in which they back the rear vertical surface of the load, the housings 61 and 62 moving into this load-backing position from their widely separated, load clearing position of FIG. 2.

Figure 9:
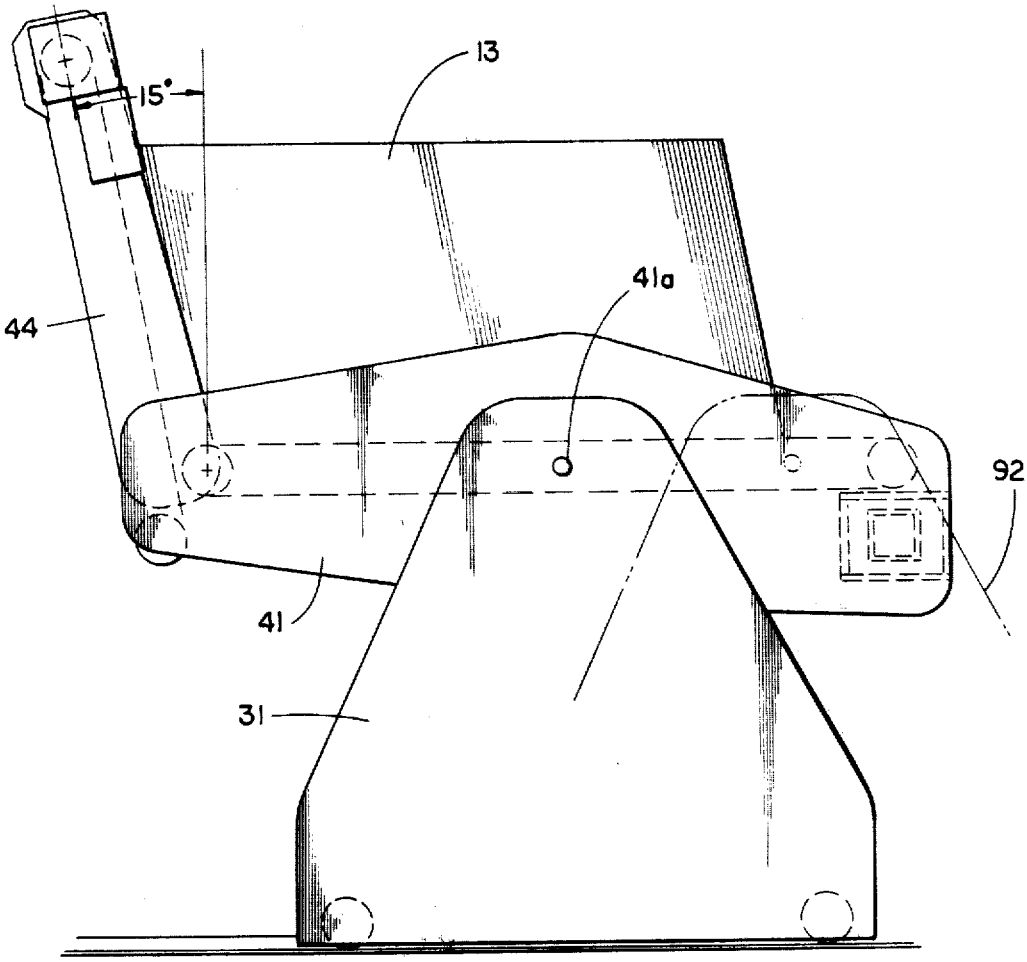
FIG. 9 is a view similar to FIG. 8 but showing the cradle in its motion from load to feed positions.

After the cradle arrives at its position of FIG. 8 and the housings 61 and 62 have assumed their position backing the load or stack 13, the cradle will pivot 90° about pivot axis 41*a*, placing legs 41 and 42 in horizontal position, as shown in FIG. 9. As this pivotal motion of the cradle is being completed the members 44 and 46 of the cradle will pivotally move to increase the included angle between the legs of the cradle by approximately 15°, this motion being indicated in FIG. 9. As shown in FIG. 9, the stack 13 will now be supported, on its side, by the conveyors 56, 57 and 58 located between cradle members 41 and 42 with the stack tilted or committed toward the cradle members 44 and 46.

Figure 10:
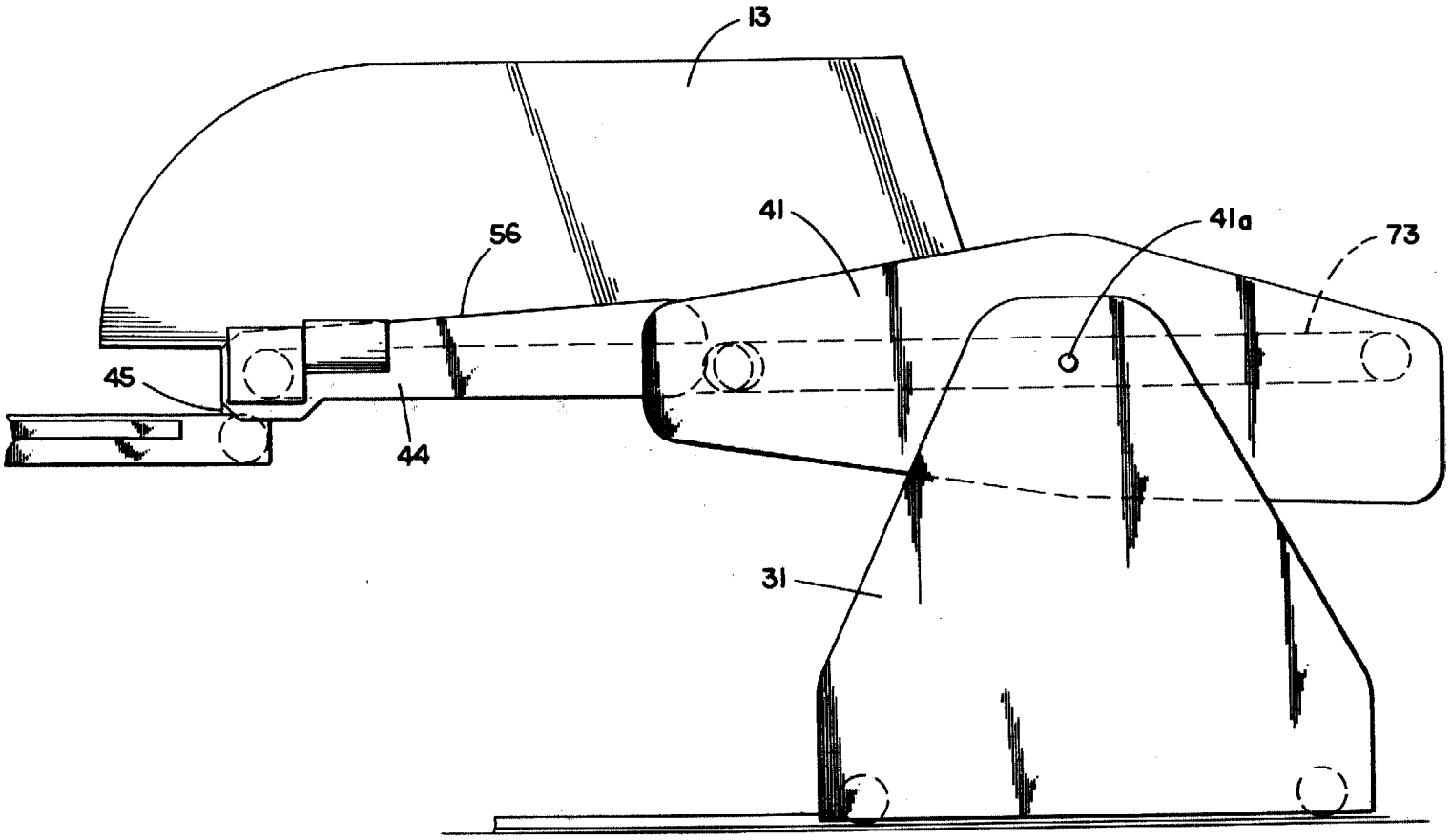
FIG. 10 is a view similar to FIG. 9 but showing the cradle after it has reached feed position.

After the position of FIG. 9 is reached, the members 44 and 46 will pivotally move further until they are in substantially horizontal alignment with the members 41 and 42, this position being shown in FIG. 10. As there indicated, the stack 13 assumes a leftwardly bevelled condition ready to be shingled or delivered off the cradle by operation of the conveyors carried by the now horizontally aligned cradle legs.

Figure 4:
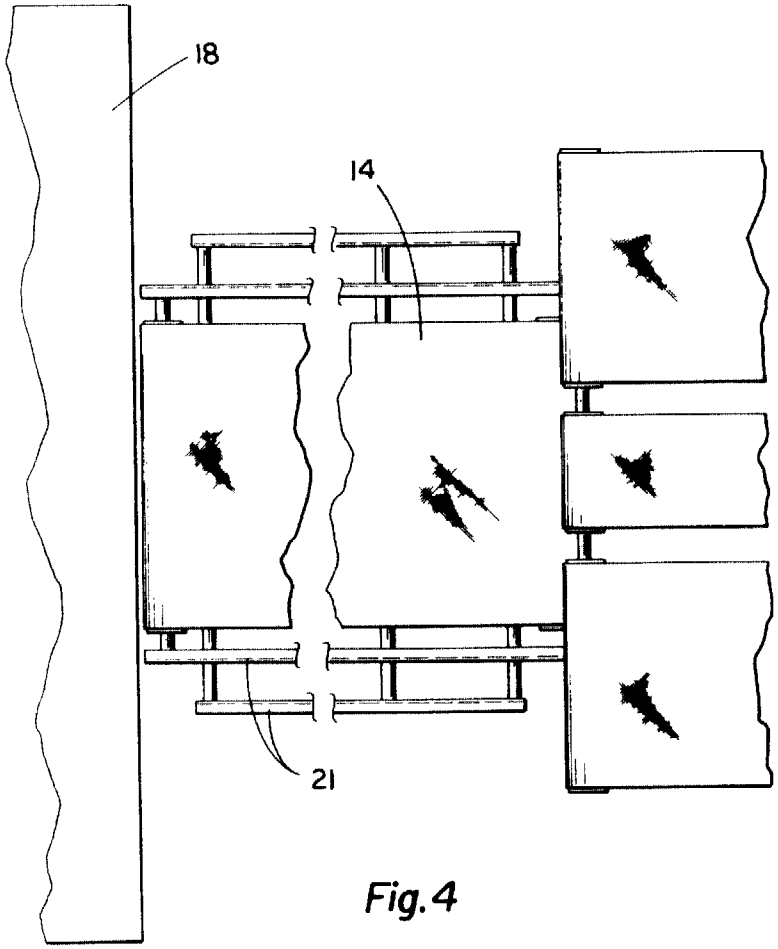
FIG. 4 is a top plan view of the structure shown in FIG. 3.

The cradle now advances leftwardly, as viewed in FIG. 10, over the powered conveyor 14 carried by the feed transfer conveyor component 12 into a feed position as shown in broken lines at 37 in FIG. 3. The leftward motion of the legs 44 and 46 and the cradle may be stopped intermediate its solid line position of FIG. 3 (and FIG. 10) and the broken line position indicated at 37 by the sensing fingers 45 (FIG. 3) engaging the trailing edge of the preceding material on the conveyor 14. The conveyors carried by the horizontally aligned cradle leg portions will now operate to flow material from the stack onto conveyor 14. Delivery of material will continue as long as conveyor 14 is running. Should conveyor 14 stop, due to the press hopper 18 (FIG. 4) being full, for example, the cradle will continue to deliver material from the stack and will travel rightwardly, as viewed in FIG. 1, toward its intermediate, or home feed, position of FIG. 10. If the conveyor 14 restarts before the cradle reaches this home position, the cradle will halt its rightward movement and continue feeding material onto conveyor 14. This action prevents gaps in the material on conveyor 14 caused by short stop intervals in the action of conveyor 14.

After the cradle has been emptied, it will retreat to its home position of FIG. 10 (assuming it is not already in this position when the stack is depleted). Thereupon the cradle will move in reverse sequence through its position of FIG. 9, the stanchions 31 and 32 moving rightwardly to shift the cradle to its load position indicated at 92 in FIG. 9 and shown in solid lines in FIG. 8. The housings 61 and 62 and the load support plates 67 carried by them will be moved outwardly to their positions of FIG. 2, clearing the cradle for receiving another stack from conveyor 22. The cycle is then repeated and the delivery end of the members 44 and 46 will advance over conveyor 14 until fingers 45 sense the trailing edge of the material from the preceding stack. The cradle is thus moved horizontally an amount sufficient to cover any feeding gap on the receiving conveyor caused by the excursion of the cradle back through its load position (FIG. 7) for reloading.

Figure 11:
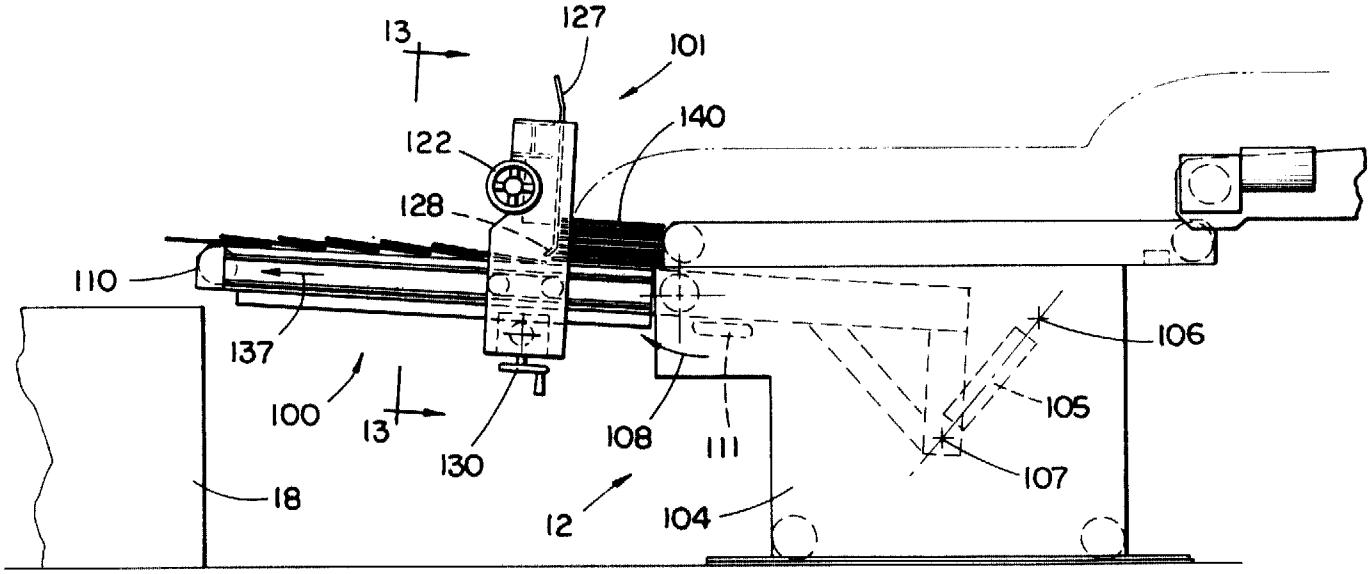
FIG. 11 is the same view as FIG. 3 only showing an optional intermediate conveyor located aft of the receiving conveyor.
Figure 13:
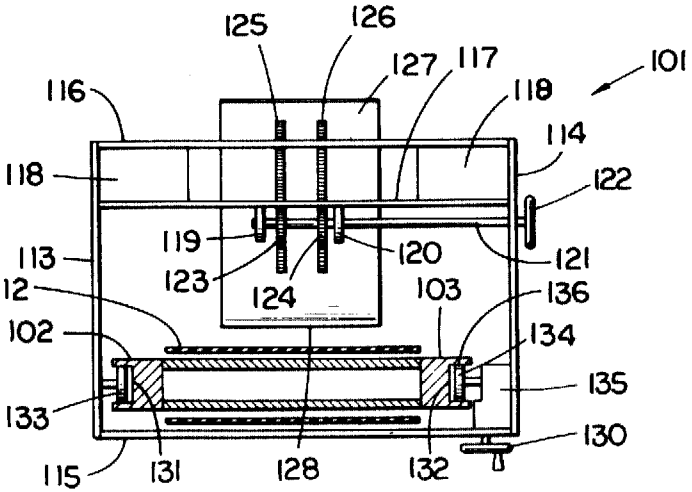
FIG. 13 is an enlarged cross-sectional view taken along the line 13—13 of FIG. 11 and viewed in the direction of the arrows.
Figure 12:
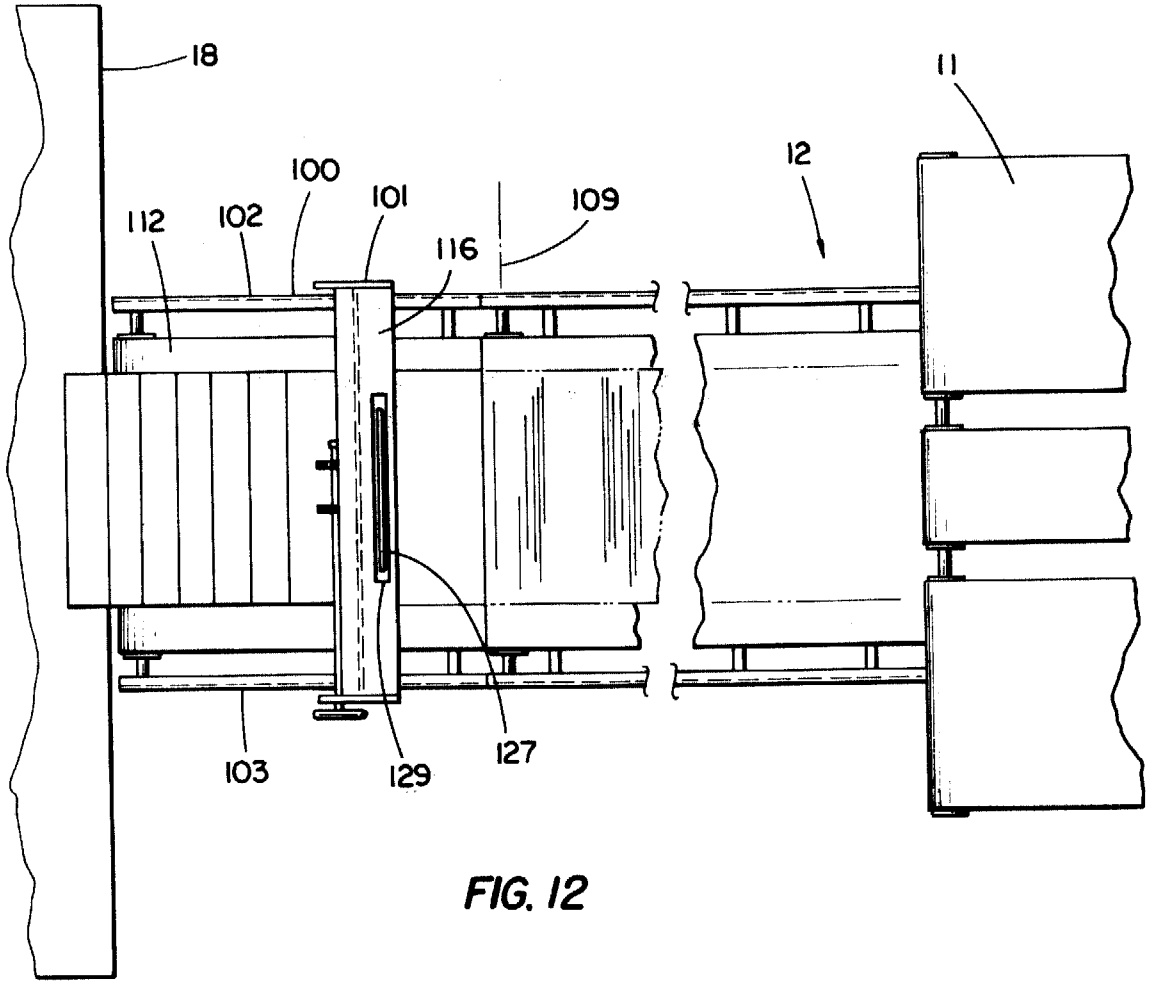
FIG. 12 is a fragmentary top plan view of the structure shown in FIG. 11.

In certain instances, it may be desirable to more accurately control the thickness of flow of shingled sheets. As shown in FIG. 10, once the stack of corrugated board sheets is laid on its side, at least some of the sheets will be extending generally horizontally, namely those sheets which are feeding into the transfer conveyor 12 (FIG. 3). A backstop gate assembly may be provided so as to allow a plurality of board sheets to accumulate in horizontal fashion with a controlled number of board sheets then being fed from the stack into a second conveyor in shingled fashion. Such a backstop gate assembly shown with a second conveyor is depicted in FIG. 11 being positioned between the receiving or transfer conveyor 12 and the press hopper 18. FIGS. 11 through 13 depict the preferred embodiment of the present invention which includes a second conveyor 100 along with an optional backstop gate assembly 101 which may be used with the transfer conveyor 12, cradle 11 and load centering section 10 previously shown and described. Transfer conveyor 12 shown in FIG. 11 is identical with the transfer conveyor 12 shown in FIG. 3 with the exception that a second conveyor 100 is pivotally mounted thereto.

Conveyor 100 is formed by a belt-over-roller powered conveyor and driven by a variable speed drive motor. Conveyor 100 includes a pair of side frames 102 and 103 (FIG. 12) which are pivotally mounted to the main frame 104 (FIG. 11) of transfer conveyor 12. A conventional cylinder motor 105 is mounted to frame 104 at location 106 and has an extendable piston rod pivotally connected to extension 107 of conveyor 100. Extension of the piston rod from cylinder motor 105 results in conveyor 100 pivoting in the direction of arrow 108 about a horizontal axis 109 (FIG. 12). Likewise, retraction of the piston rod or cylinder motor 105 results in conveyor 100 pivoting in a direction opposite of arrow 108 thereby lowering the outer distal end of conveyor 100 relative to press hopper 18. Operation of cylinder motor 105 thereby allows for the adjustment of the outer distal end 110 in a vertical direction with respect to press hopper 18. A conventional motor 111 (FIG. 11) is mounted to the side frame of conveyor 100 and is operably connected to the continuous conveyor belt 112 (FIG. 12) for driving the belt to move the shingled sheets toward press hopper 18. A variety of conventional mechanisms may be used to connect motor 111 to the drive wheels or drive rollers in turn operatively engaged with the continuous conveyor belt 112.

Backstop gate assembly 101 includes a generally rectangular sheet metal frame having a pair of vertical side walls 113 and 114 fixedly joined to a pair of spaced apart horizontal walls 115 and 116. A second reinforcing rib 117 extends between walls 113 and 114 and is mounted to the top wall 116 by a pair of spacer blocks 118. A pair of depending mounting brackets 119 and 120 have their top ends fixedly mounted to rib 117 and bearingly receive a rotatable shaft 121 rotatably mounted to wall 114 and having a band wheel 122 fixedly mounted at its outer distal end. A pair of sprocket gears 123 and 124 are mounted to shaft 121 and are in meshing engagement respectively with a pair of racks 125 and 126 fixedly mounted to one side of gate 127. Thus, rotation of hand wheel 122 in a clockwise direction as viewed in FIG. 11 results in the downward movement of gate 127 toward conveyor 100 whereas rotation of the hand wheel in a counterclockwise direction results in gate 127 moving in an upward direction. As a result, the distance between the bottom end 128 (FIG. 13) of gate 127 and the top surface of conveyor belt 112 is controlled so as to allow the operator to control the thickness of flow of shingled sheets beneath the bottom end 128 of gate 127. A slot 129 is provided (FIG. 12) in top wall 116 and rib 117 (FIG. 13) which slidably receives gate 127 limiting horizontal movement of gate 127 relative to gears 123 and 124.

A hand crank 130 (FIG. 11) is provided for adjustably moving backstop assembly 101 along the length of second conveyor 100. A pair of outwardly facing grooves or channels 131 and 132 are provided respectively in side frame members 102 and 103. Groove 131 bearingly receives a plurality of load supporting wheels 133 rotatably mounted to side wall 113. Likewise, groove 132 receives a plurality of sprocket gears 134 rotatably mounted to gear box 135 in turn mounted to walls 114 and 115. Hand crank 130 is connected through gear box 135 by a conventional gear mechanism to sprockets 134 in turn meshingly engaged with a rack 136 mounted along and extending the length of groove 132. Thus, rotation of hand crank 130 results in rotation of sprockets 134 with the entire backstop assembly 101 then moving in a direction to or from arrow 137 (FIG. 11) depending upon the direction of rotation of hand crank 130. Thus, wheels 133 and sprockets 134 support the backstop assembly upon conveyor 100 and allow for the lengthwise movement of the backstop assembly upon conveyor 100.

The apparatus shown in FIG. 11 is operated in a manner identical to that previously described for the apparatus shown in FIG. 3 with the additional step that backstop assembly 101 is first adjusted to the correct location along the length of conveyor 100 and with gate 127 also being adjusted so as to correctly control the gap between the bottom distal end of gate 127 to the top surface of belt 112.

It will be noted in FIG. 11 that the bottom distal end 128 of gate 127 extends through an approximate angle 45° from the main plane of the gate, and toward press hopper 18 thereby facilitating movement of the shingled sheets beneath gate 127. In order to decrease the thickness of flow of shingled sheets upon conveyor 100, gate 127 is moved downwardly toward belt conveyor 112 whereas movement of the gate in the upward direction away from belt conveyor 112 will increase the thickness of flow of shingled sheets. Likewise, it will be noted in FIG. 11 that backstop gate assembly 101 is located a distance away from transfer conveyor 12 at least sufficiently to allow a vertical stack 140 of the corrugated sheets to form atop conveyor 100 between gate 127 and transverse conveyor 12. In the event gate assembly 101 is located too close to conveyor 12, then a vertical stack of corrugated sheets will not form and the apparatus will not operate in an satisfactory manner. Backstop gate assembly 101 should be adjusted to the correct location along the length of conveyor 100 depending upon the particular width of the corrugated board sheets being fed to the press hopper 18.

It will be noted that the second conveyor 100 (FIG. 11) is generally positioned lower than receiving conveyor 12 particularly at the formation of the second vertical stack 140 which accumulates against gate 127. The sheets in stack 140 are generally aligned with the exception of those sheets at the very top of the stack which are being fed onto the top of stack 140 from the shingled row of sheets moving across the top of receiving conveyor 12. Assuming gate 127 is positioned sufficiently apart from the top surface of the conveyor belt on conveyor 100, the sheets will be fed from the bottom of stack 140 in shingled condition. The overall weight of stack 140 is considerably less than the weight of the original stack since the height of stack 140 is considerably less than the original stack of vertical sheets fed to the cradle.

The method of feeding the sheets includes first aligning the plurality of sheets in a first vertical stack and then feeding the vertical stack to the cradle. The cradle supports the stack with a bottom horizontal surface and a generally vertically extending surface. Next, the cradle is tilted along with the stack with the previously vertically extending legs of the cradle now moving toward horizontal and with the included angle between the legs of the cradle increasing allowing the sheets to assume a shingled configuration. The sheets are then fed in a horizontal direction in a shingled configuration across receiving conveyor 12 and eventually down atop the second conveyor 100. The leading sheets are temporarily accumulated against gate 127 into second stack 140 with the sheets from the bottom of stack 140 being fed across conveyor 100 in shingled fashion while the remaining sheets in stack 140 are restrained in the horizontal direction by gate 127.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A method of feeding sheets comprising the steps of:

aligning a plurality of sheets in a first vertical stack having a vertical stack axis;

supporting said stack with a bottom horizontal surface and a pair of vertical conveyors forming a vertical surface forming together with said horizontal surface forming an included angle of 90°;

tilting said stack with said vertical surface moving toward horizontal;

increasing said included angle during said tilting step allowing said sheets to assume a shingled configuration;

feeding said sheets in a horizontal direction in a shingled configuration on a conveyor;

temporarily accumulating in a second vertical stack the leading sheets being fed during said feeding step;

feeding sheets from the bottom of said second vertical stack in shingled fashion while restraining sheets thereabove in said second stack; and, moving said plurality of sheets remaining in said first vertical stack away from said second vertical stack when said second stack is full while simultaneously feeding said sheets in said first stack onto said conveyor.

2. The method of claim 1 comprising the additional step of:

moving after said aligning step and before said supporting step said first vertical stack between said pair of vertical conveyors which are then moved closer together and against and behind said first stack.

* * * * *